US010634141B2

(12) United States Patent
Gossen et al.

(10) Patent No.: US 10,634,141 B2
(45) Date of Patent: Apr. 28, 2020

(54) SCROLL COMPRESSOR HAVING AXIAL GUIDE SUPPORT

(71) Applicant: BITZER Kuehlmaschinenbau GmbH, Sindelfingen (DE)

(72) Inventors: Dimitri Gossen, Altdorf (DE); Muzaffer Ceylan, Baesweiler (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 284 days.

(21) Appl. No.: 15/459,594

(22) Filed: Mar. 15, 2017

(65) Prior Publication Data

US 2017/0184107 A1 Jun. 29, 2017

Related U.S. Application Data

(63) Continuation of application No. PCT/EP2015/070568, filed on Sep. 9, 2015.

(30) Foreign Application Priority Data

Sep. 17, 2014 (DE) ..... 10 2014 113 435

(51) Int. Cl.
*F03C 2/00* (2006.01)
*F03C 4/00* (2006.01)
(Continued)

(52) U.S. Cl.
CPC ..... *F04C 29/0057* (2013.01); *F01C 17/063* (2013.01); *F04C 18/0215* (2013.01);
(Continued)

(58) Field of Classification Search
CPC ..... F01C 17/063; F04C 18/0215; F04C 18/0253; F04C 23/008; F04C 27/005;
(Continued)

(56) References Cited

U.S. PATENT DOCUMENTS 4,824,344 A 4/1989 Kimura et al.
5,249,940 A * 10/1993 Matsuda ..... F04C 18/0215 418/55.5

(Continued)

FOREIGN PATENT DOCUMENTS

DE 37 37 422 A1 5/1988
DE 44 12 560 A1 10/1994

(Continued)

*Primary Examiner* — Theresa Trieu
(74) *Attorney, Agent, or Firm* — Reinhart Boerner Van Deuren P.C.

(57) ABSTRACT

To be as lightweight and compact, for example for automotive technology, a scroll compressor further includes an axial guide that supports the movable compressor body to prevent movements in the direction parallel to a centre axis of the stationary compressor body and, in the event of movements, guides it in the direction transverse to the centre axis. A coupling prevents the movable compressor body from rotating freely. The axial guide supports a compressor body base, which carries the scroll vane, of the second compressor body against an axial support face, in that the axial support face abuts a sliding body such that it is slidable transversely to the centre axis. The sliding body is slidable transversely to the centre axis, on a carrier element that is arranged in the compressor housing.

24 Claims, 16 Drawing Sheets

(51) Int. Cl.

| | |
|---|---|
| ***F04C 18/00*** | (2006.01) |
| ***F04C 29/00*** | (2006.01) |
| ***F04C 18/02*** | (2006.01) |
| ***F04C 29/02*** | (2006.01) |
| ***F04C 23/00*** | (2006.01) |
| ***F01C 17/06*** | (2006.01) |

(52) U.S. Cl.
CPC ..... *F04C 18/0253* (2013.01); *F04C 23/008* (2013.01); *F04C 29/0021* (2013.01); *F04C 29/0085* (2013.01); *F04C 29/02* (2013.01); *F04C 2240/30* (2013.01); *F04C 2240/50* (2013.01); *F04C 2240/60* (2013.01); *F04C 2240/801* (2013.01)

(58) Field of Classification Search
CPC ..... F04C 27/007; F04C 29/0021; F04C 29/0057; F04C 29/0085; F04C 29/02; F04C 2230/22; F04C 2240/30; F04C 2240/50; F04C 2240/60; F04C 2240/801; F05C 2201/021; F05C 2201/02; F05C 2201/0448; F05C 2201/0451
USPC ..... 418/55.1–55.6, 57
See application file for complete search history.

(56) References Cited

U.S. PATENT DOCUMENTS

| | | | | |
|---|---|---|---|---|
| 5,520,524 | A * | 5/1996 | Takemoto | F04C 18/0215 418/55.5 |
| 5,569,028 | A | 10/1996 | Yamamura et al. | |
| 6,158,989 | A * | 12/2000 | Barito | F04C 18/0215 418/55.1 |
| 7,658,600 | B2 | 2/2010 | Fujita et al. | |
| 8,047,823 | B2 | 11/2011 | Takei | |
| 8,628,315 | B2 | 1/2014 | Sato et al. | |
| 2002/0150485 | A1 | 10/2002 | Mori et al. | |
| 2008/0050260 | A1 | 2/2008 | Iwanami et al. | |
| 2010/0172781 | A1 | 7/2010 | Kuwahara et al. | |
| 2010/0183465 | A1 | 7/2010 | Kobayashi et al. | |
| 2011/0081264 | A1 | 4/2011 | Ishizono et al. | |
| 2011/0200475 | A1 | 8/2011 | Hirata et al. | |
| 2013/0209305 | A1 | 5/2013 | Takei | |

FOREIGN PATENT DOCUMENTS

| | | | |
|---|---|---|---|
| DE | 698 12 487 72 | T2 | 11/2003 |
| DE | 603 00 376 | T2 | 2/2006 |
| DE | 10 2007 039 629 | A1 | 4/2008 |
| DE | 11 2008 001 546 | T5 | 4/2010 |
| EP | 0 890 709 | A1 | 1/1999 |
| EP | 1 413 759 | A2 | 4/2004 |
| EP | 1 950 419 | A1 | 7/2008 |
| EP | 2 012 015 | A1 | 1/2009 |
| EP | 2 012 016 | A1 | 1/2009 |
| JP | S62159780 | A | 7/1987 |
| JP | 2012 241530 | A | 12/2012 |
| JP | 2013 130143 | A | 7/2013 |
| JP | 2014 101835 | A | 6/2014 |

* cited by examiner

SCROLL COMPRESSOR HAVING AXIAL GUIDE SUPPORT

CROSS-REFERENCE TO RELATED PATENT APPLICATION

This application is a continuation of International application number PCT/EP2015/070568 filed on Sep. 9, 2015.

This patent application claims the benefit of International application No. PCT/EP2015/070568 of Sep. 9, 2015 and German application No. 10 2014 113 435.4 of Sep. 17, 2014, the teachings and disclosure of which are hereby incorporated in their entirety by reference thereto.

BACKGROUND OF THE INVENTION

The invention relates to a compressor, including a compressor housing, a scroll compressor unit that is arranged in the compressor housing and has a first, stationary compressor body and a second compressor body that is movable in relation to the stationary compressor body, whereof first and second scroll vanes, in the shape of a circle involute, engage in one another to form compressor chambers when the second compressor body is moved in relation to the first compressor body on an orbital path, an axial guide that supports the movable compressor body to prevent movements in the direction parallel to a centre axis of the stationary compressor body and, in the event of movements, guides it in the direction transverse to the centre axis, a drive motor that drives an eccentric drive for the scroll compressor unit, wherein the eccentric drive has an entrainer that is driven by the drive motor, that revolves on a path about a centre axis of the drive shaft and that cooperates with an entrainer receptacle in the second compressor body, and a coupling that prevents the second compressor body from rotating freely.

Compressors of this kind are known from the prior art.

A requirement of these compressors is that they are constructed to be as lightweight and compact as possible, so that they can be used for example in automotive technology.

SUMMARY OF THE INVENTION

This object is achieved according to the invention in the case of a compressor of the type mentioned in the introduction in that the axial guide supports a compressor body base, which carries the scroll vane, of the second compressor body against an axial support face, in that the axial support face abuts a sliding body such that it is slidable transversely to the centre axis, the sliding body for its part being supported, such that it is slidable transversely to the centre axis, on a carrier element that is arranged in the compressor housing.

The advantage of the solution according to the invention can be seen in the fact that, as a result of the sliding body provided between the axial support face of the compressor body base and the carrier element on the compressor housing, it is possible to guide the second compressor body on the one hand with optimum support and on the other with little wear, since the sliding body that is arranged between the axial support face and the carrier element creates the possibility of providing an optimum supply of lubricant.

In theory, the sliding body could be movable in one dimension, either in relation to the compressor body base or in relation to the carrier element.

It is particularly favourable if the sliding body is movable in two dimensions, in relation to the compressor body base and in relation to the carrier element.

This makes sufficient lubrication of the support between the axial support face and the sliding body, and between the sliding body and the carrier element, achievable simply and reliably.

Particularly advantageously, movability of the sliding body can be achieved if the sliding body is guided in a two-dimensional guidance with play in relation to the compressor body base or in relation to the carrier element.

Here, guidance with play allows the two-dimensional movability of the sliding body to be achieved in a simple manner and for the permitted extent thereof to be established.

For example, guidance with play makes it possible to establish that the sliding body can perform a limited guiding orbital movement in relation to the compressor base or in relation to the carrier element.

Here, the orbital movement is advantageously defined by a guiding orbital radius that is smaller than the compressor orbital radius of the movable compressor body. For example, the values of the guiding orbital radius for the sliding body are equal to 0.5 that of the compressor orbital radius. It is better if the values of the guiding orbital radius are 0.3 that of the compressor orbital radius or less, and even better 0.2 that of the compressor orbital radius or less.

In order to obtain a minimum lubrication, the guiding orbital radius is 0.01 that of the compressor orbital radius or more, and, better, 0.05 that of the compressor orbital radius or more.

More detailed comments have not yet been made as regards the form taken by the guidance with play.

Here, an advantageous solution provides for the guide to have a first guiding element that is arranged on the sliding body and a second guiding element that is either connected to the compressor body base or to the carrier element.

The most diverse possibilities are conceivable for the form taken by the guiding elements.

It is particularly favourable if the guidance with play has, as the guiding elements, a guide pin and a guide recess that cooperates with the guide pin, and these are movable in two dimensions in relation to one another in that the guide pin engaging in the guide recess is movable within the guide recess as a result of its diameter, which is smaller than the diameter of the guide recess.

The most diverse possibilities are conceivable for achieving the form taken by the axial support face.

For example, it is conceivable for the axial support face to be composed of individual partial faces that are arranged on the second compressor body.

These partial faces may then be arranged in different regions of the second compressor body.

In order to achieve optimum support, lubrication and guidance, however, it is preferably provided for the axial support face to take the form of an annular face surrounding the centre axis of the movable compressor body.

An annular face of this kind enables reliable, uniform and secure support of the second compressor body and at the same time the creation of a homogeneous film of lubricant, which is very important for the guidance properties and the resistance to wear.

In this case, the axial support face could be supported against individual face regions of the sliding body.

However, it is particularly favourable if the axial support face is supported on an annular face of the sliding body that surrounds the centre axis.

Preferably in this case, the annular face of the sliding body is dimensioned such that it is larger than the annular face of the axial support face, with the result that the axial support face is always supported over its full surface on the annular face of the sliding body as the second compressor body orbits.

In order to ensure optimum provision of lubricant for a lubricant film between the axial support face and the sliding body, it is preferably provided for the axial support face to be adjoined, radially outwardly and/or radially inwardly, by an edge face that is set back in relation to a plane in which the axial support face extends.

A particularly favourable solution provides for the edge face to directly adjoin the axial support face and thus also to reach as far as the plane in which the axial support face extends, and then to run at an increasing spacing from the plane in which the axial support face extends as its spacing from the axial support face increases. When the edge face has for example a step-shaped or wedge-shaped course of this kind, the supply of lubricant to the axial support face from the outside thereof is assisted.

The supply of lubricant between the axial support face and the sliding body may be further assisted if the axial support face and/or a sliding support face that carries the axial support face is provided with micro-recesses, for example micro-recesses that result from the material and/or are machined and/or stamped in, and that receive, retain and distribute lubricant.

More detailed comments have not yet been made as regards guidance of the sliding body in relation to the carrier element.

Here, an advantageous solution provides for the sliding body to be supported against the carrier element by means of a sliding bearing face.

The sliding bearing face could in this case likewise be formed by partial faces.

It is particularly favourable if the sliding bearing face takes the form of an annular face surrounding the centre axis of the stationary compressor body.

Furthermore, it is preferably provided for the carrier element to have a carrier face against which the sliding body is supported by means of the sliding bearing face.

This carrier face could also be formed by individual partial faces.

However, it is particularly advantageous if the carrier face takes the form of an annular face rotating about the centre axis of the stationary compressor body.

The supply of lubricant between the carrier element and the sliding body may be further assisted if the sliding bearing face and/or a carrier face that carries the sliding bearing face is provided with micro-recesses, for example micro-recesses that result from the material and/or are machined and/or stamped in, and that receive, retain and distribute lubricant.

Further, more detailed comments have not been made as regards the form taken by the sliding body.

In principle, the sliding body could take any desired shape.

For reasons of manufacturing engineering, it is particularly favourable if the sliding body takes a plate-like form, in particular as an annular disc.

Further, more detailed comments have not been made as regards the choice of materials in the compressor according to the invention.

Here, an advantageous solution provides for the first, stationary compressor body to be made from cast steel.

A first compressor body of this kind made from cast steel has optimum stability and fatigue strength.

Further, it is preferably provided for the second compressor body to be made from an aluminium alloy, in particular from cast aluminium alloy.

Manufacturing the second compressor body from an aluminium alloy has the advantage that this second compressor body has a small mass, which is advantageous in particular if the second compressor body is to move at high speed on the orbital path about the centre axis of the first compressor body.

Further, pairing the materials of an aluminium alloy and cast steel for the first and the second compressor body has the advantage of good running properties with high fatigue strength and long service life.

More detailed comments have not been made in conjunction with the description given above of the individual embodiments as regards the material for the sliding body.

In principle, the sliding body could be made from any desired material, although there should be an optimum pairing of materials for the second compressor body and the carrier element.

Here, it has proved particularly advantageous if the sliding body is made from spring steel.

Forming the sliding body from spring steel has the advantage on the one hand that it provides a favourable pairing of materials with the second compressor body, made from aluminium, and on the other hand that it also allows an optimum pairing of materials with the carrier element.

Moreover, forming the second sliding body from spring steel also has major advantages for cost reasons, since spring steel is an inexpensive material from which the shape suitable for the sliding body can be made in simple manner by cutting or punching.

More detailed comments have not yet been made as regards the carrier element.

In the simplest case, the carrier element could be made from steel or indeed from the material of the compressor housing.

In order to achieve a very sturdy construction, however, it is preferably provided for the carrier element to be made from sintered material, for example sintered metal.

A particularly favourable solution provides for the carrier element to have a carrier face formed by an open-pored sintered material, on which the sliding body is supported by means of its sliding bearing face.

An open-pored sintered material of this kind for forming the carrier face has the major advantage that it can advantageously take up lubricant and then also discharge it for the purpose of lubrication between the carrier face and the sliding bearing face.

In this case, the lubricant may be held in particular in the open pores of the sintered material such that a film of lubricant can be permanently maintained between the carrier face and the sliding bearing face in a simple manner.

The use of sintered material that is softer than the spring steel of the sliding element has proved favourable, such that a pairing of the materials of the carrier element and the sliding body that is advantageous for sliding guidance is produced.

As an alternative or in addition to the solution described above to the object mentioned in the introduction, in the case of a further compressor of the type described in the introduction it is provided for the axial guide to support the second compressor body against an axial support face that is formed by the latter such that it is slidable transversely in relation to the centre axis, and for the axial support face to be formed by a compressor body base that carries the scroll vane.

A solution of this kind may be produced in a manner that is in particular advantageous for production engineering, since there is no need for a separate part for forming the support face, but rather the support face may itself be formed by the compressor body base.

In particular, in this case it is favourable if the entrainer receptacle is integrated in the compressor body base such that there is no need for a further part for this either.

Preferably in this case, the entrainer receptacle is arranged on the compressor body base such that it does not project beyond the support face in the direction parallel to the centre axis of the movable compressor body, with the result that the forces acting on the entrainer receptacle when the second compressor body is driven, as seen in the direction parallel to the centre axis, act on the second compressor body between the support face and the scroll vanes and hence the tilting moments that act on the second compressor body during operation of the scroll compressor unit are kept small.

As an alternative or in addition to the exemplary embodiments described above, for the purpose of solving the object mentioned in the introduction it is provided, in the case of a further compressor, for the coupling that prevents free rotation to have at least two coupling element sets that include at least two coupling elements.

A coupling of this kind may be achieved in the most diverse ways. In order to achieve advantageous support of the second compressor body in relation to the compressor housing with a coupling of this kind, it is preferably provided for one of the coupling elements to be held on the compressor body base.

Further, it is preferably provided for one of the coupling elements to be held on the carrier unit.

In this case, the coupling element sets are thus arranged and take a form such that they act directly between the carrier unit and the compressor body base of the second compressor body, with the result that a compact construction may be achieved.

In order to improve guidance of the second compressor body in relation to the compressor housing by the coupling, it is preferably provided for the coupling that prevents free rotation to have more than two coupling element sets.

More detailed comments have not yet been made as regards the coupling element sets.

Here, an advantageous solution provides for the coupling element sets to be arranged at equal angular spacings around the centre axis of the orbital path.

More detailed comments have not yet been made as regards the form taken by the coupling elements themselves.

Here, an advantageous solution provides for one of the coupling elements to be formed by a pin body.

Moreover, it is advantageously provided for one of the coupling elements to take the form of a cylindrical receptacle.

A further advantageous solution provides for one of the coupling elements to take the form of an annular body arranged in the cylindrical receptacle.

Preferably, it is provided here for the annular body to be seated in the cylindrical receptacle loosely, that is to say with play, and thus to be able to move in relation to the cylindrical receptacle.

A construction of this kind of the coupling element sets has the major advantage on the one hand that they ensure optimum lubrication and on the other that they enable low-noise movement of the second compressor body in relation to the first compressor body, since in each of the coupling element sets there are two films of lubricant with a damping action, namely on the one hand a film of lubricant between the pin body and the annular body and on the other a film of lubricant between the annular body and the cylindrical receptacle in which the annular body is arranged.

More detailed comments have not yet been made as regards the arrangement of the coupling element sets in relation to the sliding body.

In principle, the sliding body and the coupling element sets could be arranged separately from one another.

For example, the sliding body could extend peripherally around the outside of the coupling element sets, or vice versa.

It is advantageous if the coupling element sets pass through the sliding body such that lubricant can be transported between the sliding body and the coupling element sets, in particular if the coupling element sets pass through openings in the sliding body.

In order in particular also to lubricate the coupling element sets to the optimum, it is preferably provided for the compressor body base of the second compressor body to be provided with pockets that have openings facing the cylindrical receptacles of the coupling element sets.

Pockets of this kind, with openings facing the cylindrical receptacles, have the advantage that lubricant is entrained thereby as the second compressor body base orbits, and so lubricant can always be transported to the cylindrical receptacles.

The action of the pockets is particularly favourable if the openings in the pockets are positionable to overlap in each case with two cylindrical receptacles that are arranged succeeding one another in the peripheral direction, that is to say that in this case the openings in the pockets have an angular extent such that, as the compressor body base orbits, they can in each case connect two pockets to one another in individual angular positions and so lubricant can advantageously be transported from one cylindrical receptacle to the next cylindrical receptacle.

The features of the solution according to the invention that have been described in conjunction with the embodiments above are particularly advantageous if the centre axis of the stationary compressor body extends in a level position.

Here, an extent in the level position of the centre axis of the stationary compressor body means that during operation of the compressor according to the invention the centre axis extends approximately parallel to the horizontal, wherein the term "approximately parallel" should be understood to mean that the angle between the centre axis and the horizontal when the compressor according to the invention is used in a normal operating mode is at most 30°, or better at most 20°.

Further, in the solution according to the invention it is likewise advantageously provided for the drive shaft of the drive motor to extend substantially in a level position, wherein the same conditions apply to the angle between the centre axis of the drive shaft and the horizontal as for the alignment of the centre axis of the stationary compressor body in relation to the horizontal.

Moreover, it is advantageous for the object stated in the introduction if the compressor housing is also made from an aluminium alloy, so that the compressor according to the invention can be constructed with as low a weight as possible.

Moreover, this also gives the compressor better resistance to the influence of external weather conditions.

Further features and advantages of the invention form the subject matter of the description below and the representation in the drawing of some exemplary embodiments.

DETAILED DESCRIPTION OF THE INVENTION

Figure 1:
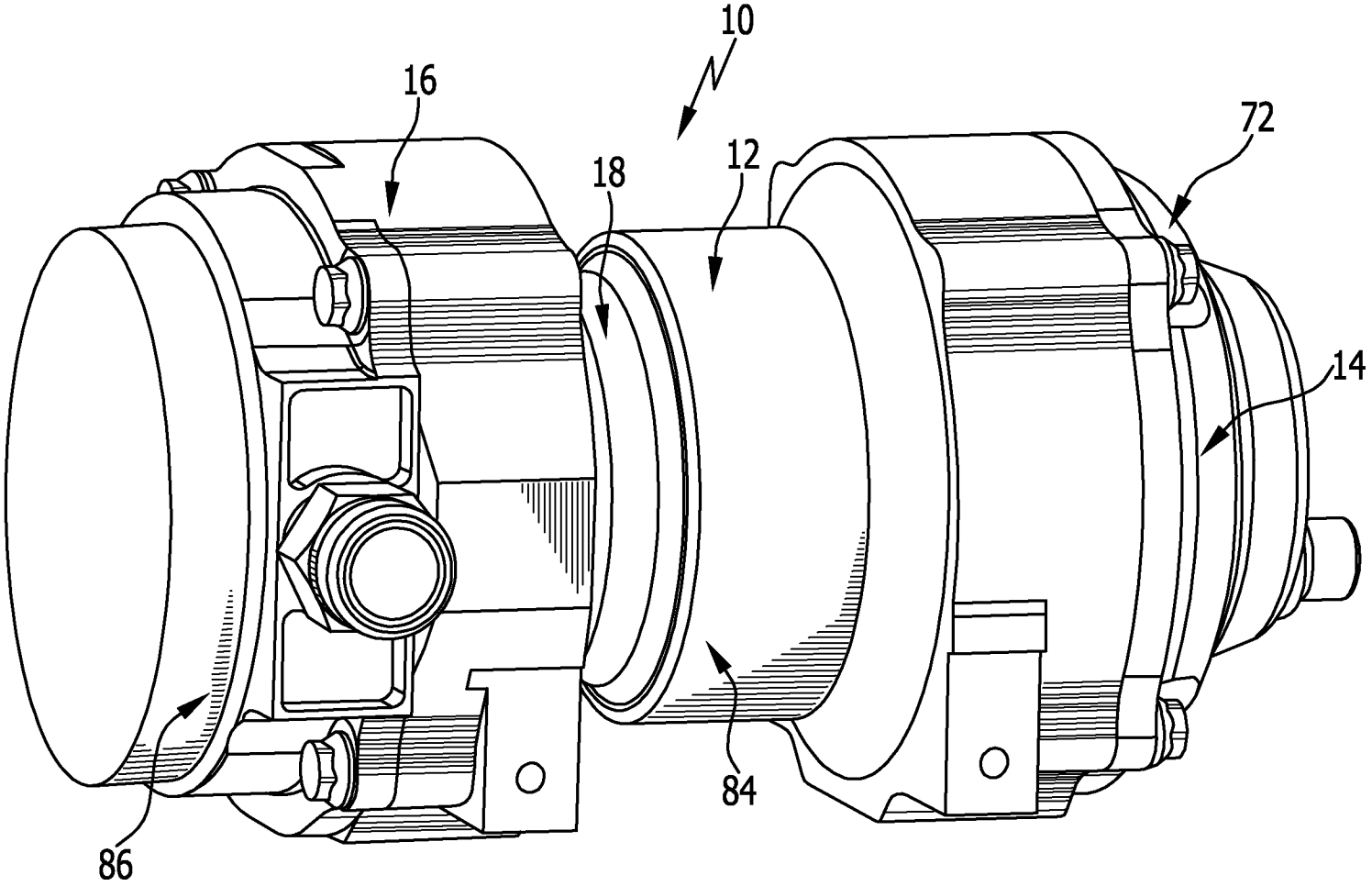
FIG. 1 shows a perspective illustration of a compressor according to the invention.

An exemplary embodiment illustrated in FIG. 1, of a compressor according to the invention which is designated 10 as a whole, and is for a gaseous medium, in particular a refrigerant, includes a compressor housing which is designated 12 as a whole and has a first end housing portion 14, a second end housing portion 16 and an intermediate portion 18 arranged between the end housing portions 14 and 16.

Figure 2:
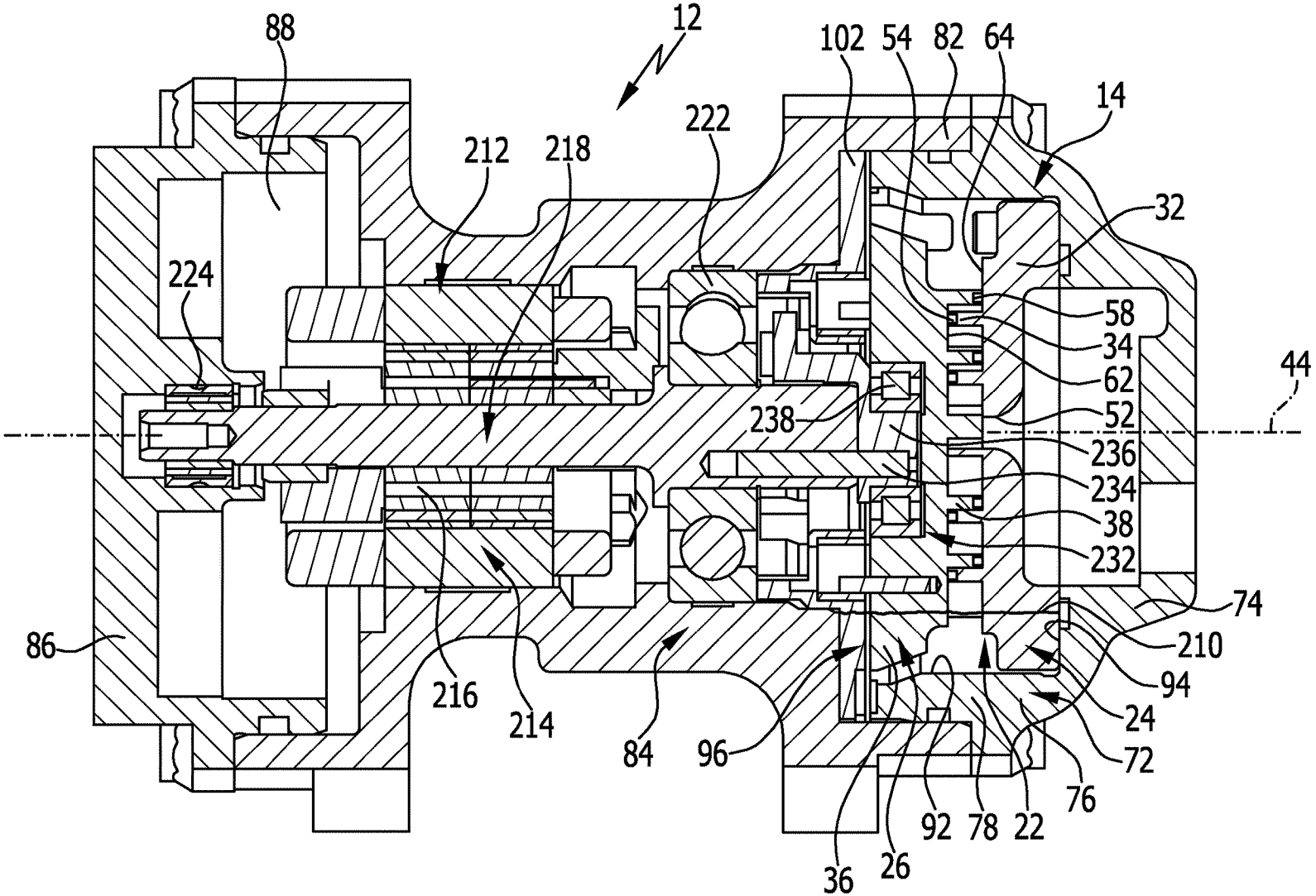
FIG. 2 shows a longitudinal section through the compressor according to the invention, in a plane of section extending through a centre axis of a stationary compressor body.

As illustrated in FIG. 2, provided in the first housing portion 14 is a scroll compressor unit which is designated 22 as a whole and has a first compressor body 24, which is arranged to be stationary in the compressor housing 12, in particular in the first housing portion 14, and a second compressor body 26, which is movable in relation to the stationary compressor body 24.

The first compressor body 24 includes a compressor body base 32 surmounted by a first scroll vane 34, and the second compressor body 26 likewise includes a compressor body base 36 surmounted by a second scroll vane 38.

Figure 3:
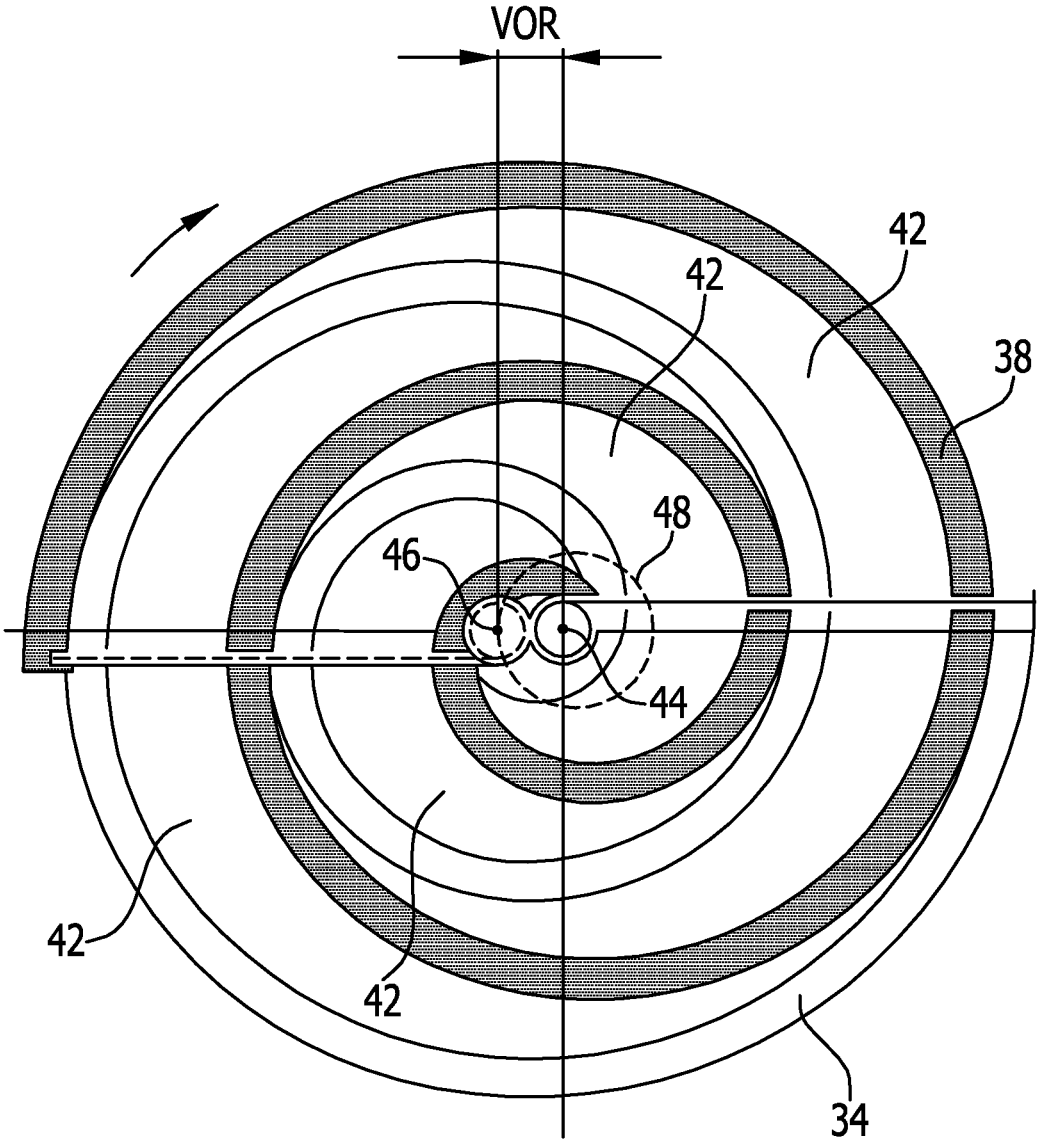
FIG. 3 shows a cross section through a scroll compressor unit, in the region of the mutually engaging scroll vanes, and an illustration of an orbital path of the movable scroll vane in relation to the stationary scroll vane.

The compressor bodies 24 and 26 are arranged in relation to one another such that the scroll vanes 34, 38 engage in one another in order to form between them, as illustrated in FIG. 3, at least one and preferably a plurality of compressor chambers 42 in which the gaseous medium, for example refrigerant, is compressed in that the second compressor body 26 moves with its centre axis 46 about a centre axis 44 of the first compressor body 24 on an orbital path 48 having a compressor orbital path radius VOR, wherein the volume of the compressor chambers 42 decreases and ultimately compressed gaseous medium emerges through a central outlet 52, while gaseous medium to be drawn in is drawn in on the radially outer side in relation to the centre axis 44, through peripherally opening compressor chambers.

The compressor chambers 42 are also sealed off from one another in particular in that the scroll vanes 34, 38 are provided on their end side with axial sealing elements 54 and 58 respectively, which abut sealingly against the respective bottom face 62, 64 of the respectively other compressor body 26, 24, wherein the bottom faces 62, 64 are formed by the respective compressor body base 36 and 32 respectively and lie in a plane extending perpendicular to the centre axis 46.

The scroll compressor unit 22 is received as a whole in a first housing body 72 of the compressor housing 12, wherein this housing body 72 has an end cover portion 74 and a cylindrical annular portion 76 that is integrally formed in one piece with the end cover portion 74 and for its part engages by means of an annular projection 78 in an end bushing 82 of a central housing body 84 that forms the intermediate portion 18, wherein the central housing body 84 is terminated at a side opposite the first housing body 72 by a second housing body 86 that forms an inlet chamber 88 for the gaseous medium.

Here, by means of the cylindrical annular portion 76, the first housing body 72 surrounds a receptacle 92 for the scroll compressor unit 22, and this receptacle has a bearing face 94 for the compressor body base 32 of the first compressor body 24.

In particular, the first compressor body 24 is immovably fixed in the receptacle 92 in a manner preventing any movement parallel to the bearing face 94.

In this way, the first compressor body 24 is fixed within the first housing body 72 and thus also within the compressor housing 12 such that it is stationary in a precisely defined position.

The second, movable compressor body 26, which has to move on the orbital path 48 about the centre axis 44 in relation to the first compressor body 24, is guided in relation to the centre axis 44 in the axial direction by an axial guide, which is designated 96 as a whole and supports and guides the compressor body base 36 at a flat side 98 remote from the scroll vane 38, in the region of an axial support face 102, such that the compressor body base 36 of the second compressor body 26 is supported, in relation to the first compressor body 24 that is positioned stationary in the compressor housing 12, and in the direction parallel to the centre axis 44, such that the axial sealing elements 58 remain against the bottom face 64 and do not lift away therefrom, wherein at the same time the compressor body base 36 can move with the axial support face 102 such that it can slide transversely to the centre axis 44 in relation to the axial guide 96.

Figure 4:
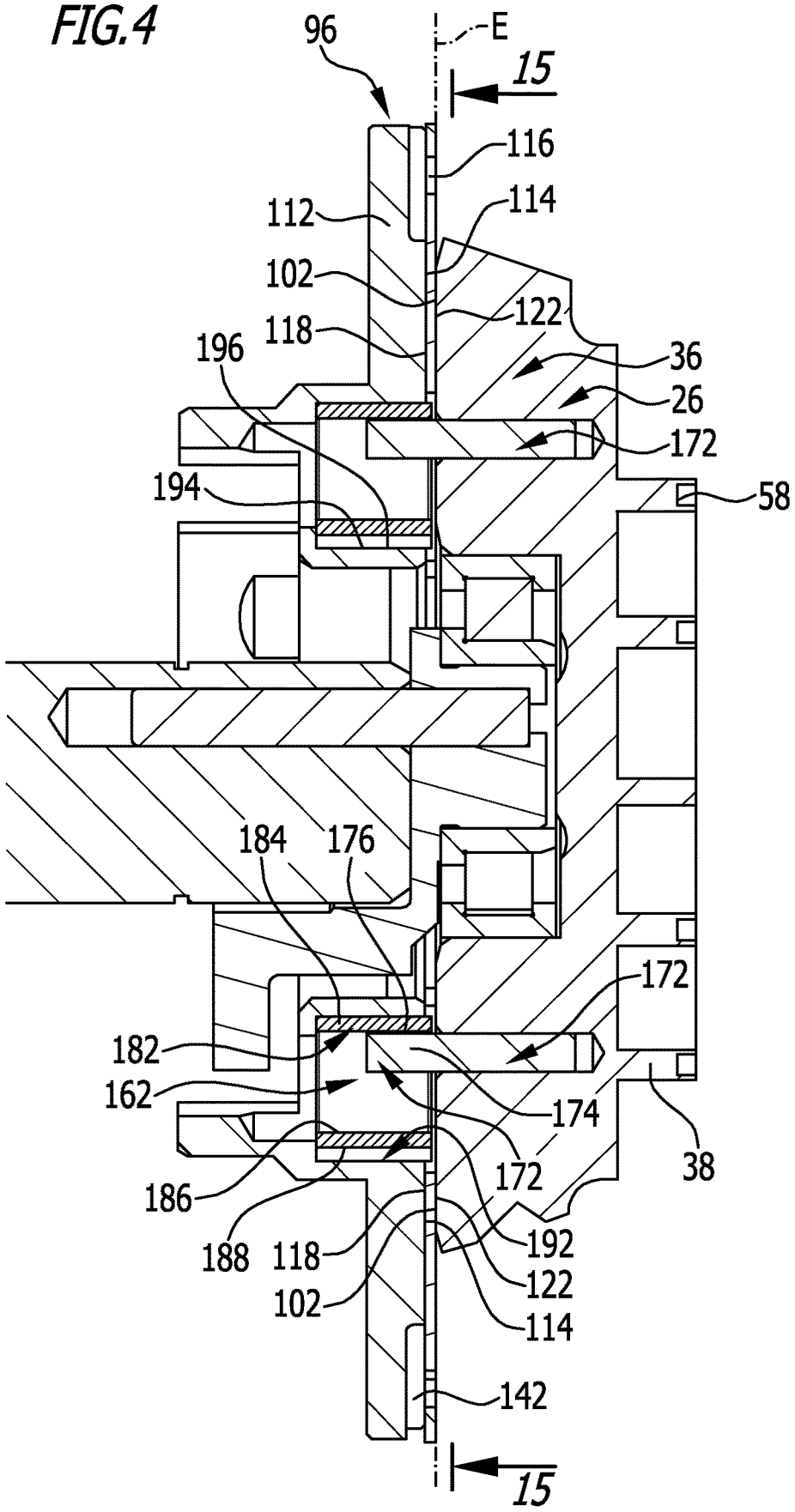
FIG. 4 shows a longitudinal section according to FIG. 2 on a larger scale, in the region of the movable compressor body and an axial guide for the movable compressor body.
Figure 5:
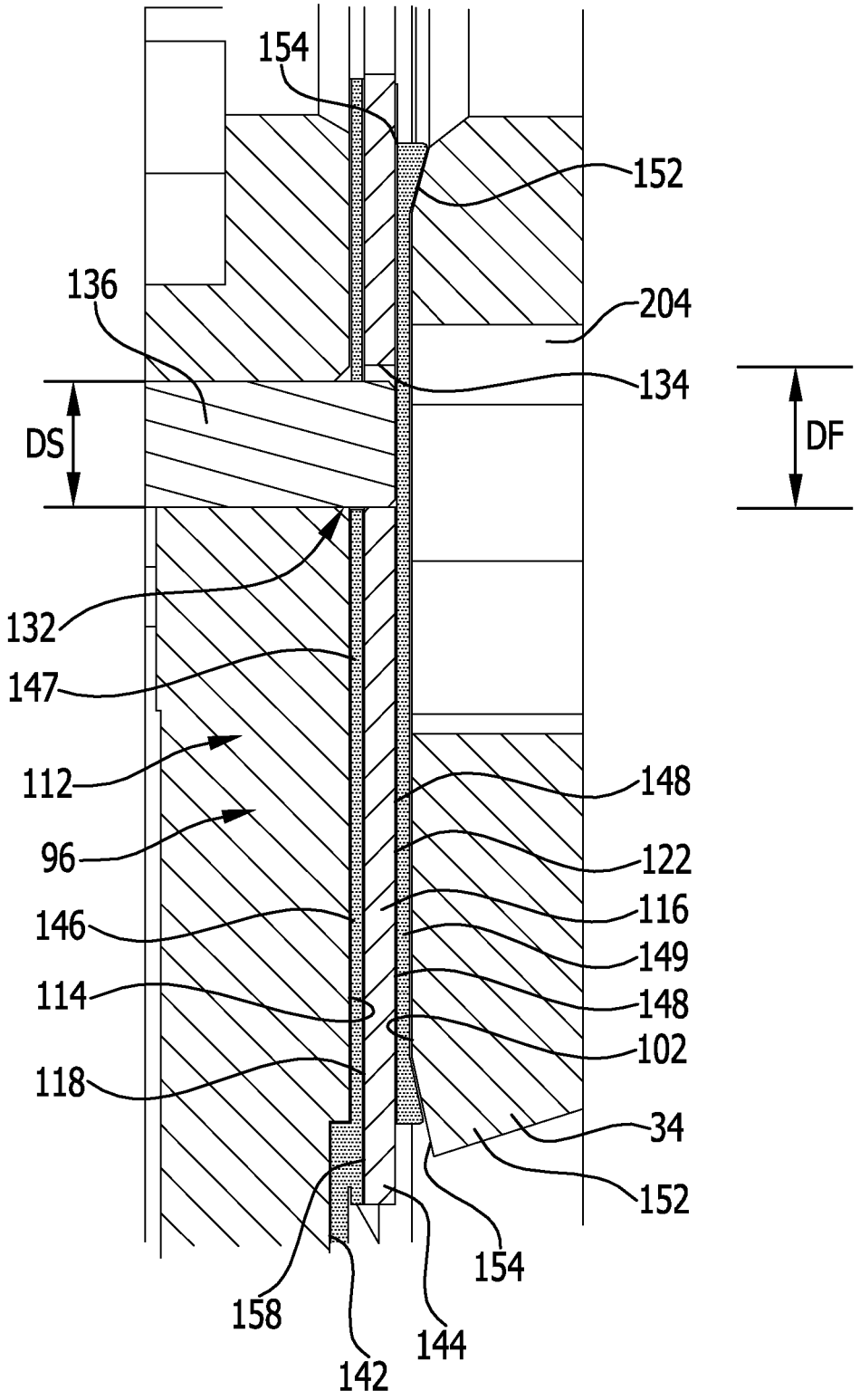
FIG. 5 shows a section on an even larger scale, through a partial region of the axial guide, in the region of guidance with play for a sliding body of the axial guide.

For this purpose, as illustrated in FIG. 4, the axial guide 96 is formed by a carrier element 112, which is made in particular from an open-pored sintered material and has a carrier face 114 that faces the axial support face 102 but on which the compressor body base 36 does not lie by means of the axial support face 102, but rather on which there lies a sliding body 116, in particular plate-like and designated 116 as a whole, having a sliding bearing face 118, wherein the sliding body 116 guides the axial support face 102 in a manner supported by means of a sliding support face 122 opposing the sliding bearing face 118, to prevent movements parallel to the centre axis 44, but supported such that it is slidable in respect of movements transverse to the centre axis 44.

In this way, an axial movement of the second compressor body 26 in the direction of the centre axis 44 is prevented, but a movement in a plane transverse, in particular perpendicular, to the centre axis 44 is made possible.

Here, the axial guide 96 according to the present invention provides, in the event of a movement of the second compressor body 26 on the orbital path 48 about the centre axis 44 of the first compressor body 24, on the one hand for the second compressor body 26 to move with the compressor body base 36 and the axial support face 102 thereof in relation to the sliding body 116, and on the other hand for the sliding body 116 itself to move in relation to the carrier element 118.

In this way, sliding takes place between the compressor body base 36 and the sliding body 116 as a result of a movement of the axial support face 102 in relation to the sliding support face 122 of the sliding body 116, and moreover the sliding bearing face 118 of the sliding body 116 slides in relation to the carrier face 114 of the carrier element 112.

Figure 6:
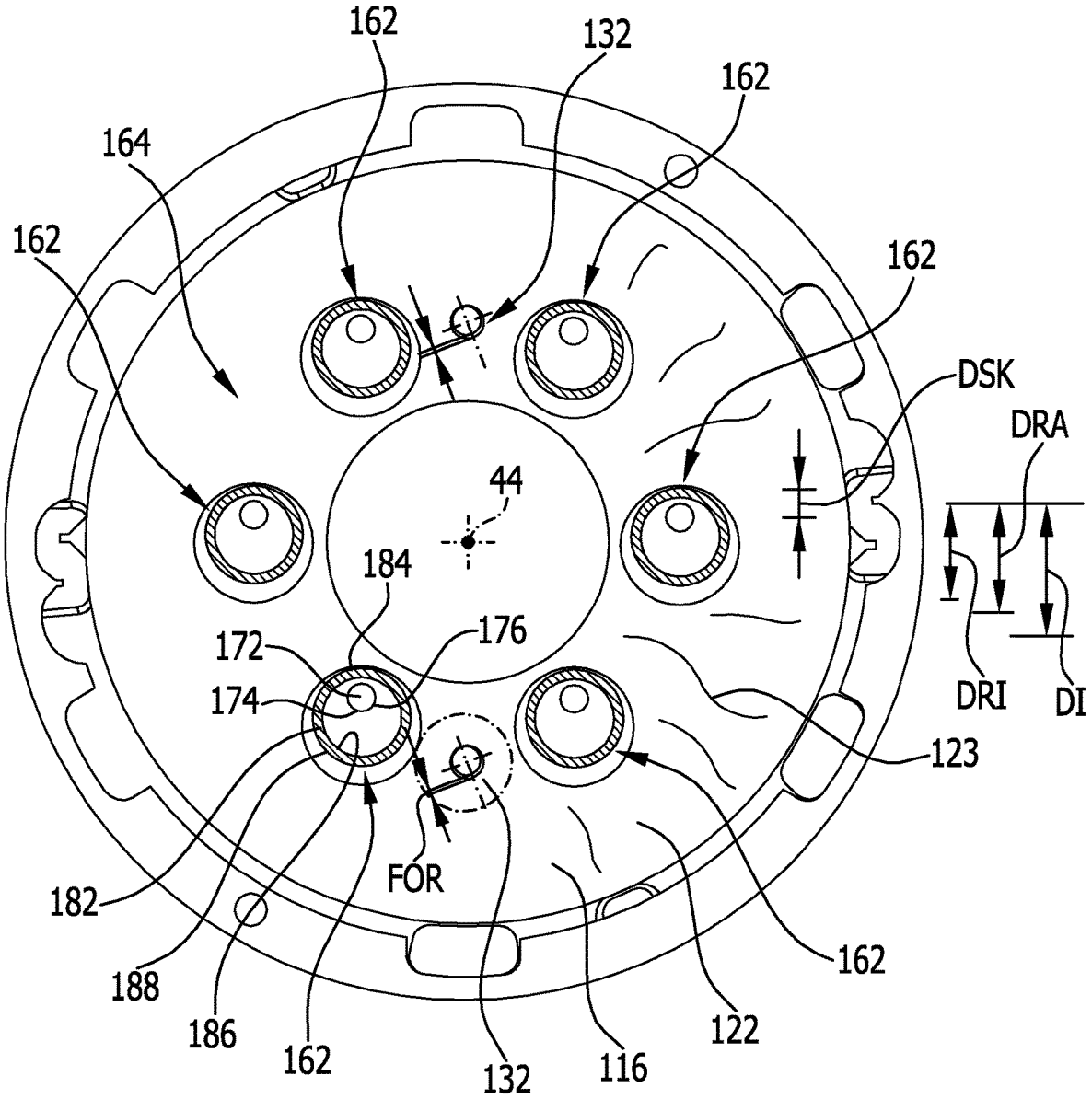
FIG. 6 shows a plan view of the axial guide, with the sliding body and a carrier element that carries the latter.
Figure 7:
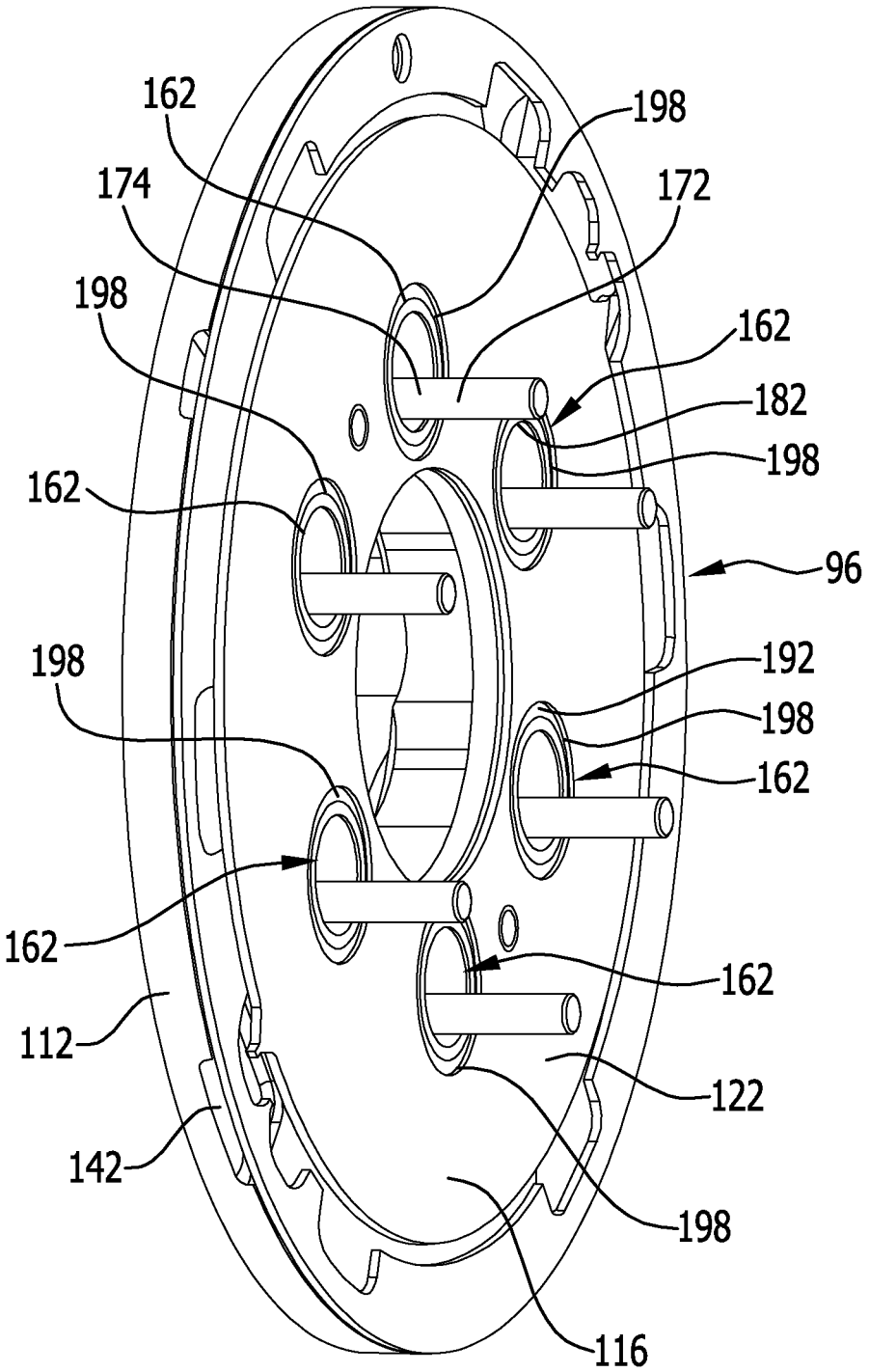
FIG. 7 shows a perspective illustration of the axial guide, together with coupling elements of a coupling for preventing it from rotating freely, including a plurality of coupling element sets.

To improve lubrication, for example the sliding support face 122 and the sliding bearing face 118 of the sliding body 116 are provided with recesses 123, in particular micro-recesses, which form receptacles for a lubricant and contribute to distribution of the lubricant, as illustrated by way of example in FIG. 6 in conjunction with the sliding support face 122.

In order to predetermine the limited two-dimensional movability of the sliding body 116 in relation to the carrier element 112 and parallel to a plane E perpendicular to the centre axis 44, the sliding body 116 is guided in relation to the carrier element 112 by a guidance with play which is designated 132 as a whole, wherein the guidance with play 132 includes a guide cutout 134 that is provided in the sliding body 116 and has a diameter DF, and also includes a guide pin 136 that is anchored in the carrier element 112 and whereof the diameter DS is smaller than the diameter DF, with the result that half of the difference DF-DS defines a guide orbital radius FOR by means of which the sliding body 116 can perform an orbital movement in relation to the carrier element 112.

In order to ensure that a sufficient film of lubricant is formed between the axial support face 102 of the compressor body base 36 and the sliding support face 122 of the sliding body 116, and between the carrier face 114 and the sliding bearing face 118, the carrier element 112 is provided with radially outward pockets 142 that extend below an outer edge region 144 of the sliding body 116 and thus facilitate the access of lubricant into an intermediate space 146 between the carrier face 114 and the sliding bearing face 118.

Further, because of the movement of the sliding body 116 with the guide orbital radius FOR in relation to the carrier element 112, the intermediate space 146 is filled with a film of lubricant 147 in a manner similar to the mode of operation of a hydrodynamic bearing.

For a stable film of lubricant 147, it is sufficient if the guide orbital radius FOR is 0.01 times the compressor orbital radius VOR or more, in particular 0.05 times the compressor orbital radius VOR or more.

In particular, the guide orbital radius FOR is 0.3 times the compressor orbital radius VOR or less, or, better, 0.2 times the compressor orbital radius VOR or less.

Further, as a result of the fact that the carrier element 112 is made, at least in the region of the carrier face 114, from an open-pored sintered material, in addition improved lubrication is ensured in that lubricant enters the pores of the carrier element 112 and is thus retained in the region of the carrier face 114 for the purpose of forming the film of lubricant 147 in the intermediate space 146, by way of the pores of the carrier element 112.

The formation of the film of lubricant 147 in the intermediate space is additionally assisted by the fact that the sliding body 116 itself takes the form of a plate-like annular part and made of spring steel, and so the sliding bearing face 118 facing the carrier face 114 creates a smooth surface of spring steel.

Further, the pairing of materials made from open-pored sintered material, which is softer in the region of the carrier face 114 than spring steel, and the spring steel in the region of the sliding bearing face 118 has advantageous properties when used over the long term, because of the resistance to wear.

In order furthermore to ensure that a film 149 of lubricant is formed in an intermediate space 148 between the sliding support face 122 and the axial support face 102, the compressor body base 36 is provided, in a radially outward and a radially inward region 152, with an edge surface 154 that extends inclined to the axial support face 102, is set back in relation to the axial support face 102 and, together with the sliding bearing face 122, results in an intermediate space 158 that opens radially outwardly or radially inwardly in the shape of a wedge and facilitates the access of lubricant to the intermediate space 148.

As illustrated in FIGS. 4, 6, 7 and 8, the axial support face 102 and the sliding support face 122 cooperating therewith and the carrier face 114 and the sliding bearing face 118 cooperating therewith are all arranged radially outwardly of a plurality of coupling element sets 162, which are arranged at the same radial spacings from the centre axis 44 and at the same angular spacings peripherally around the centre axis 44, and together form a coupling 164 that prevents the second, movable compressor body 26 from rotating freely.

Each of these coupling element sets 162 includes, as illustrated in FIGS. 4 and 6 to 8, as the first coupling element 172 a pin body 174 that has a cylindrical surface 176 and, by means of this cylindrical surface 176, engages in a second coupling element 182.

The second coupling element 182 is formed by an annular body 184 that has a cylindrical internal face 186 and a cylindrical external face 188, which are arranged coaxially to one another.

This second coupling element 182 is guided in a third coupling element 192, which takes the form of a receptacle 194, provided in the carrier element 112, for the annular body 184 and has a cylindrical internal wall surface 196.

Here, in particular a diameter DI of the internal wall surface 196 is greater than a diameter DRA of the cylindrical external face 188 of the annular body 184, and a diameter DRI of the cylindrical internal face 186 is necessarily smaller than the diameter DRA of the cylindrical external face 188 of the annular body 184, wherein moreover the diameter DRI of the cylindrical internal face 186 is greater than a diameter DSK of the cylindrical superficial face 176 of the pin body 174.

In this way, each coupling element set 162 forms a separate orbital guide, whereof the maximum orbital radius OR for the orbital movement corresponds to DI/2−(DRA−DRI)−DSK/2.

By dimensioning the orbital radius OR of the coupling element sets 162 such that it is slightly greater than the compressor orbital radius VOR, defined by the compressor bodies 24 and 26 of the scroll compressor unit 22, the movable compressor body 26 is guided in relation to the stationary compressor body 24 by the coupling 164 such that, as illustrated in FIGS. 9 to 14, in each case one of the coupling element sets 162 acts to prevent free rotation of the second, movable compressor body 26, wherein, for example if there are six coupling element sets 162, after an angular range of 60° has been covered, the action of each coupling element set 162 changes from one coupling element set 162 to the succeeding coupling element set 162 in the direction of rotation.

Because each coupling element set 162 has three coupling elements 172, 182 and 192, and in particular an annular body 184 acts between the respective pin body 174 and the respective receptacle 194, on the one hand the resistance to wear of the coupling element sets 162 is improved and on the other the lubrication in the region thereof is improved, and moreover the development of noise in the coupling element sets 162, produced by the change in action from one coupling element set 162 to the next coupling element set 162, is also reduced.

Here, it is in particular essential that the coupling element sets 162 are given sufficient lubrication, in particular lubrication between the cylindrical superficial face 176 of the pin body 174 and the cylindrical internal face 186 of the annular body 184, and lubrication between the cylindrical external face 188 of the annular body 184 and the cylindrical internal wall surface 196 of the receptacle 194.

One possibility provides for the coupling element sets 162 to pass through the sliding body 116, in particular for the pin bodies 174 to pass through openings 198 (FIG. 7) in the sliding body 116, as a result of which lubricant from the lubricant films 147 and 149 can be supplied to the coupling element sets 162.

Figure 8:
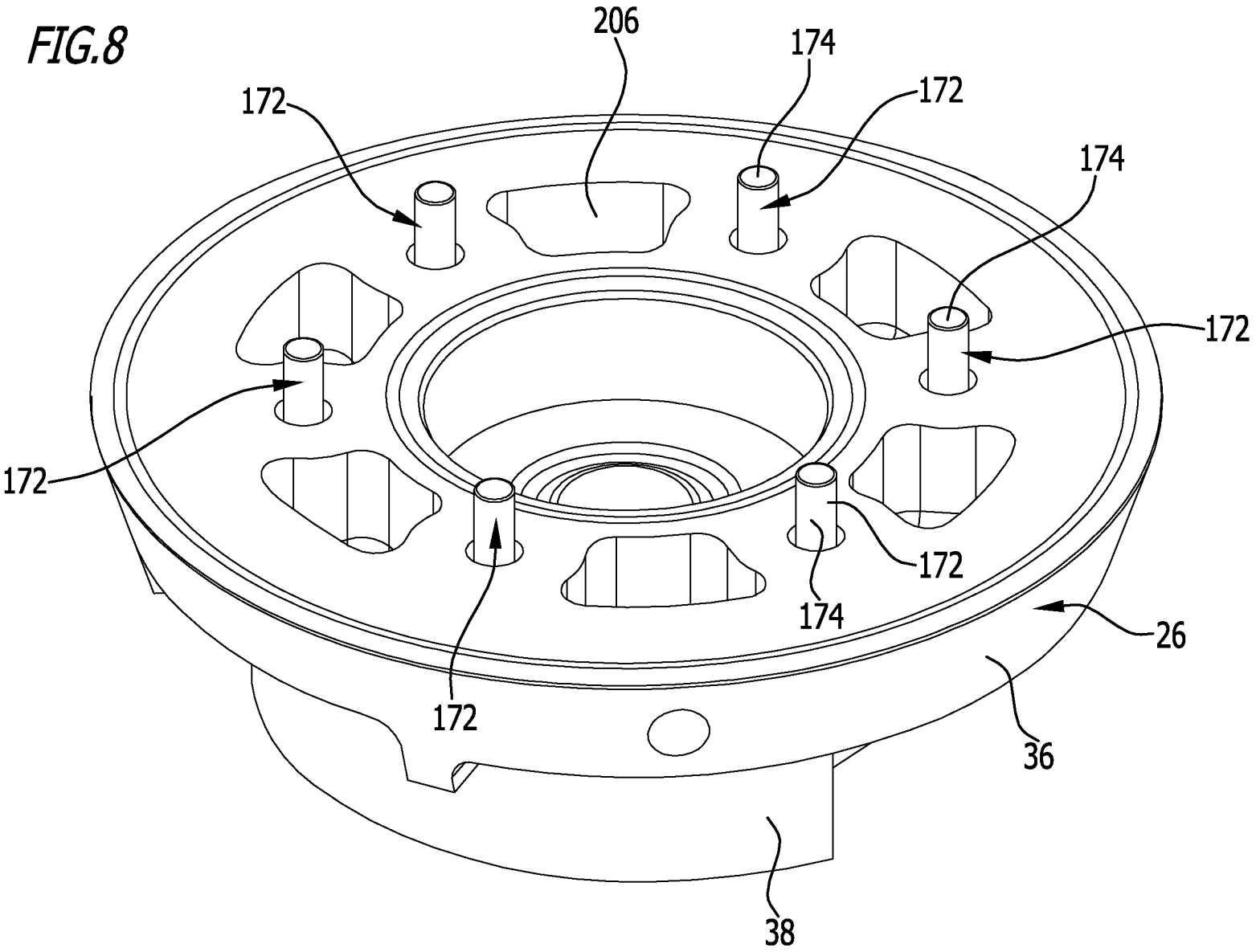
FIG. 8 shows a plan view of a flat side of the movable compressor body, opposite the scroll vane.
Figure 9:
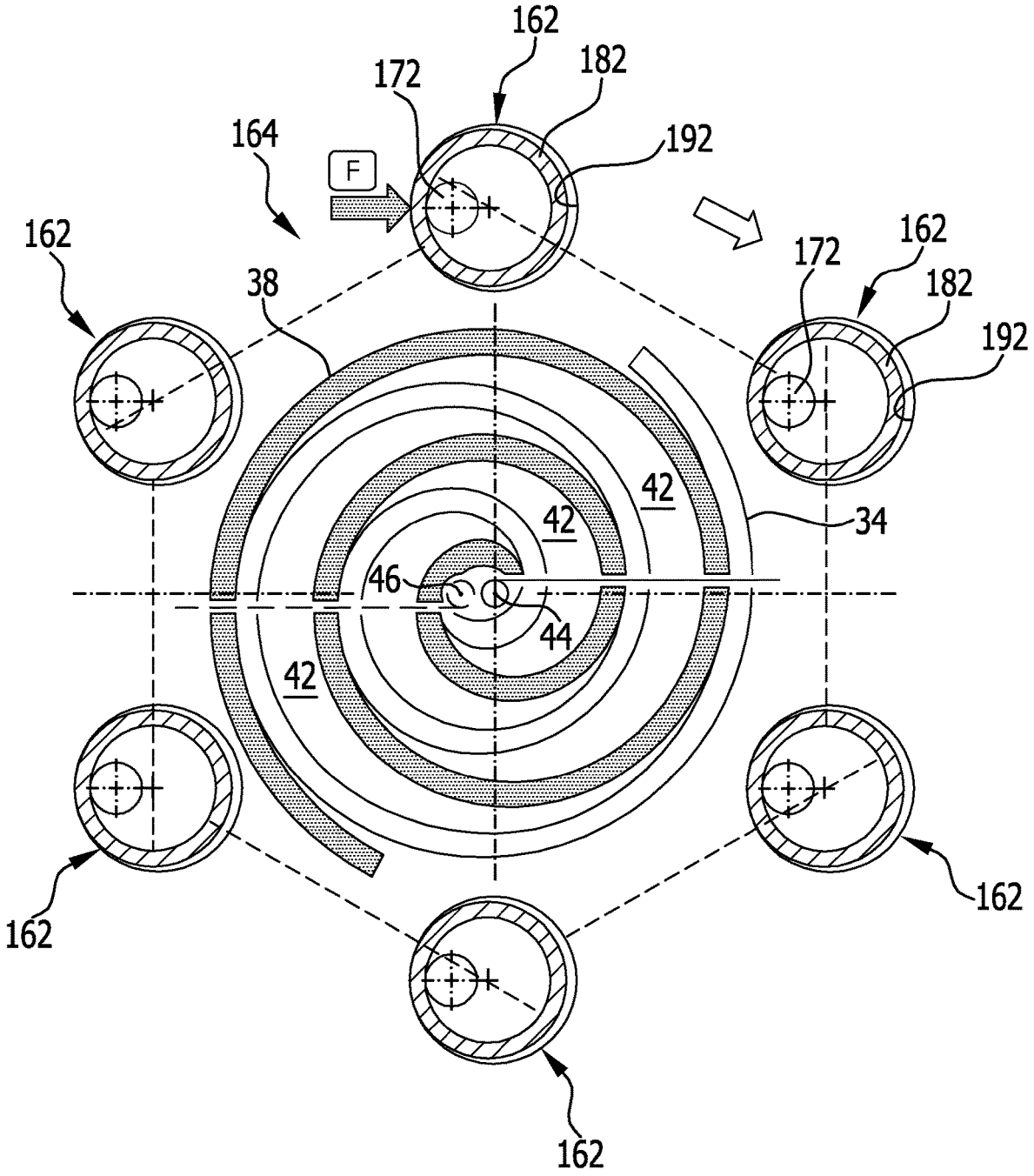
FIG. 9 to FIG. 14 show a schematic illustration of the cooperation between the coupling element sets of the coupling that prevents free rotation.
Figure 10:
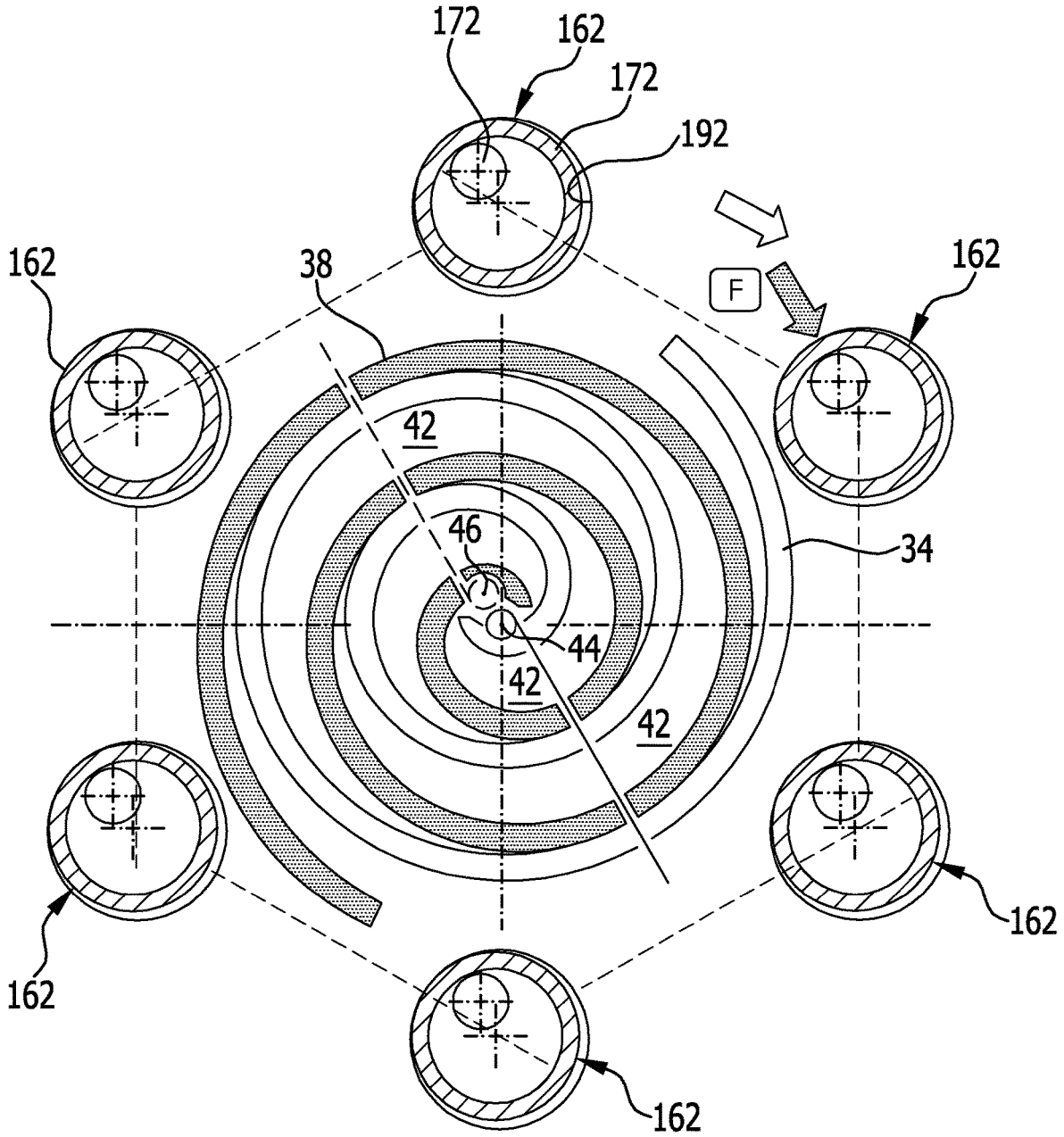
Figure 11:
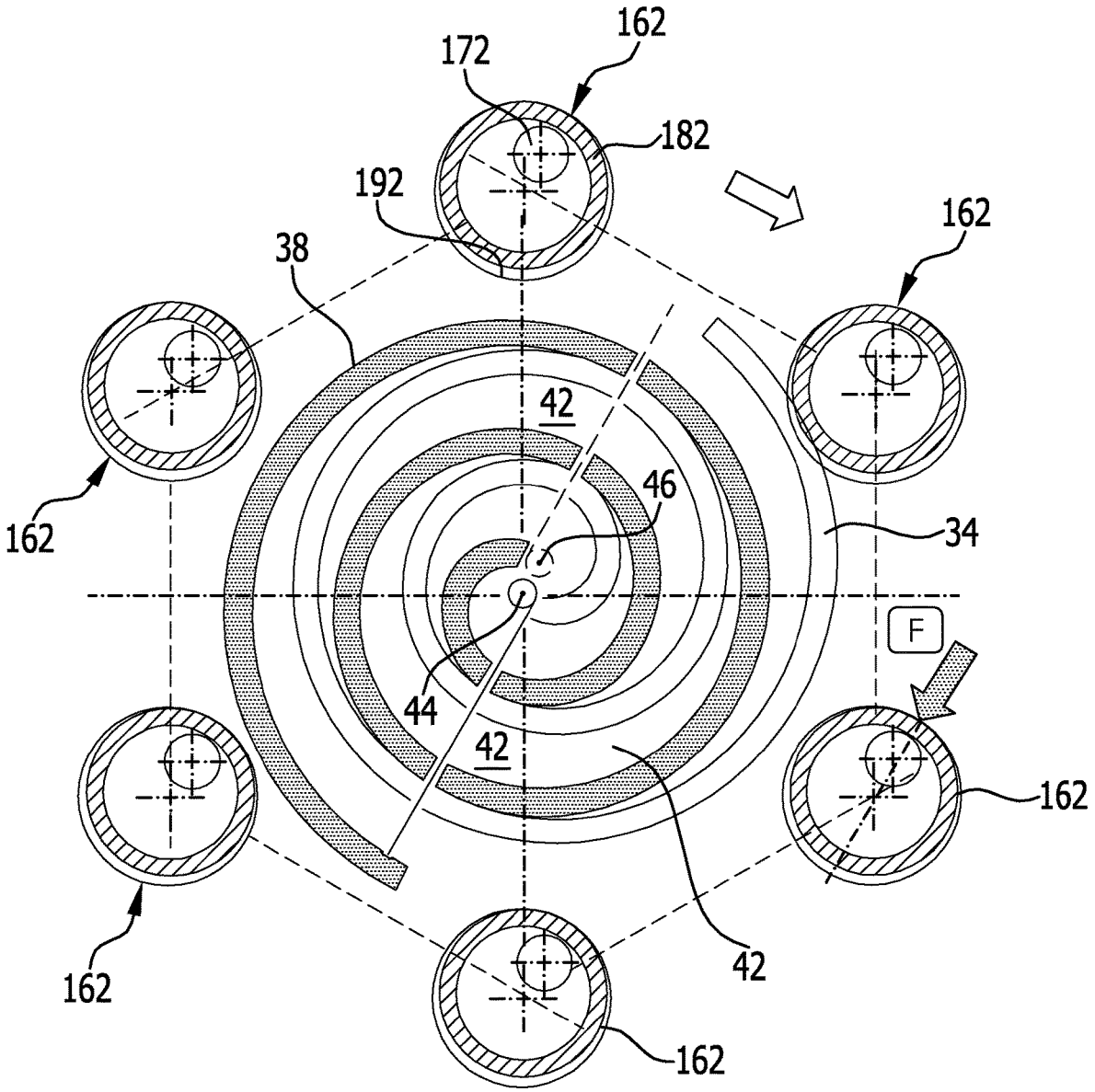
Figure 12:
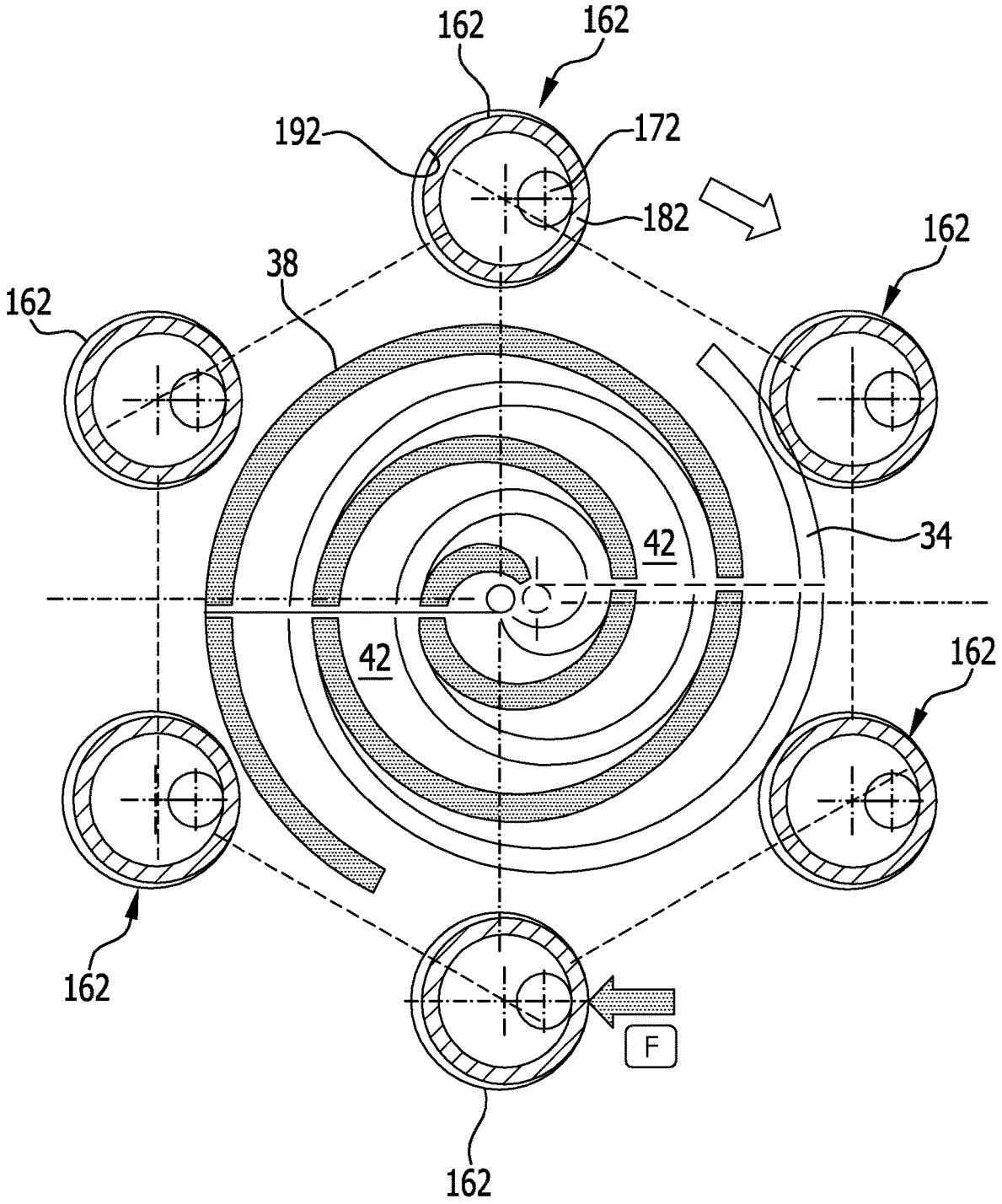
Figure 13:
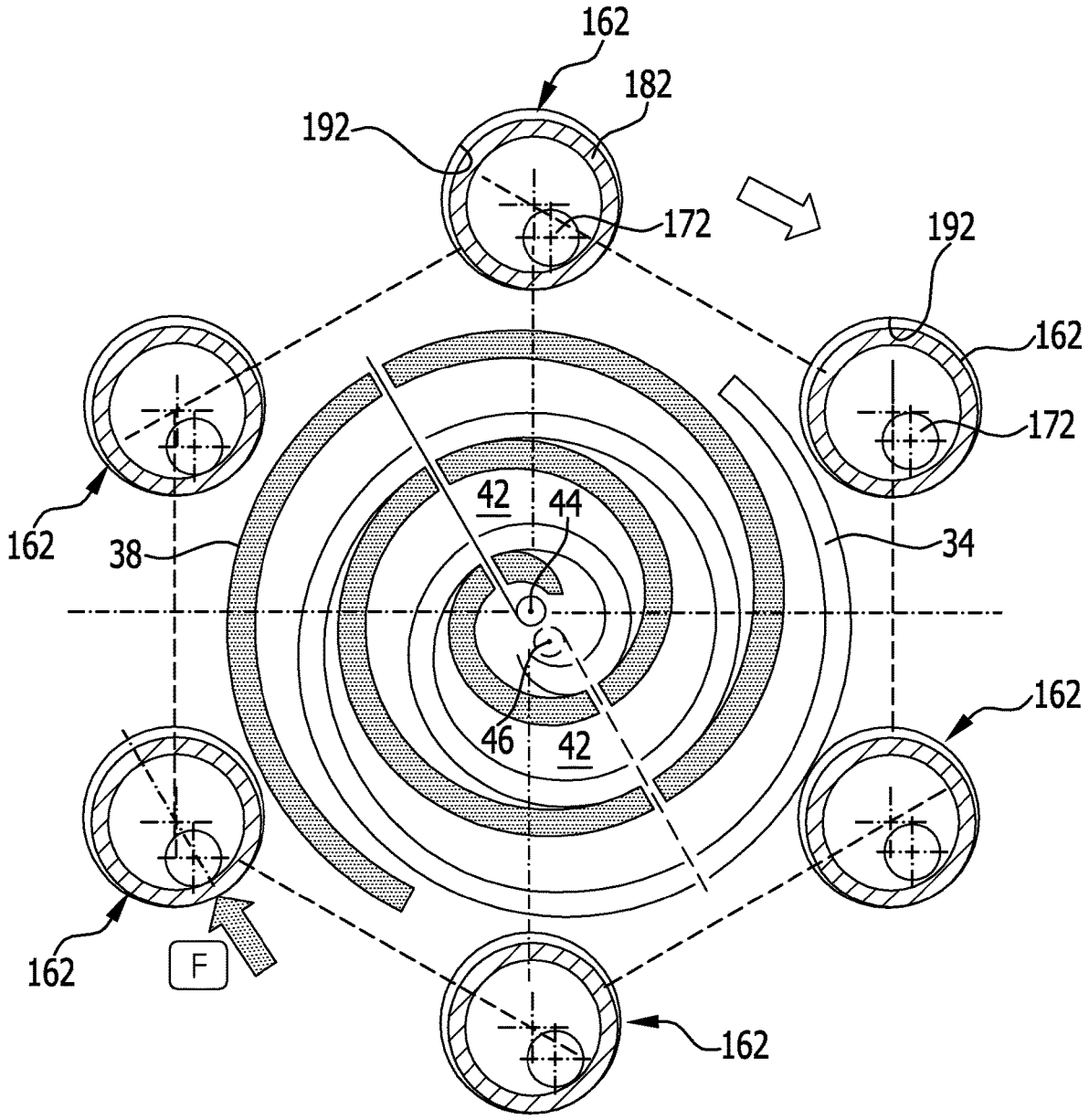
Figure 14:
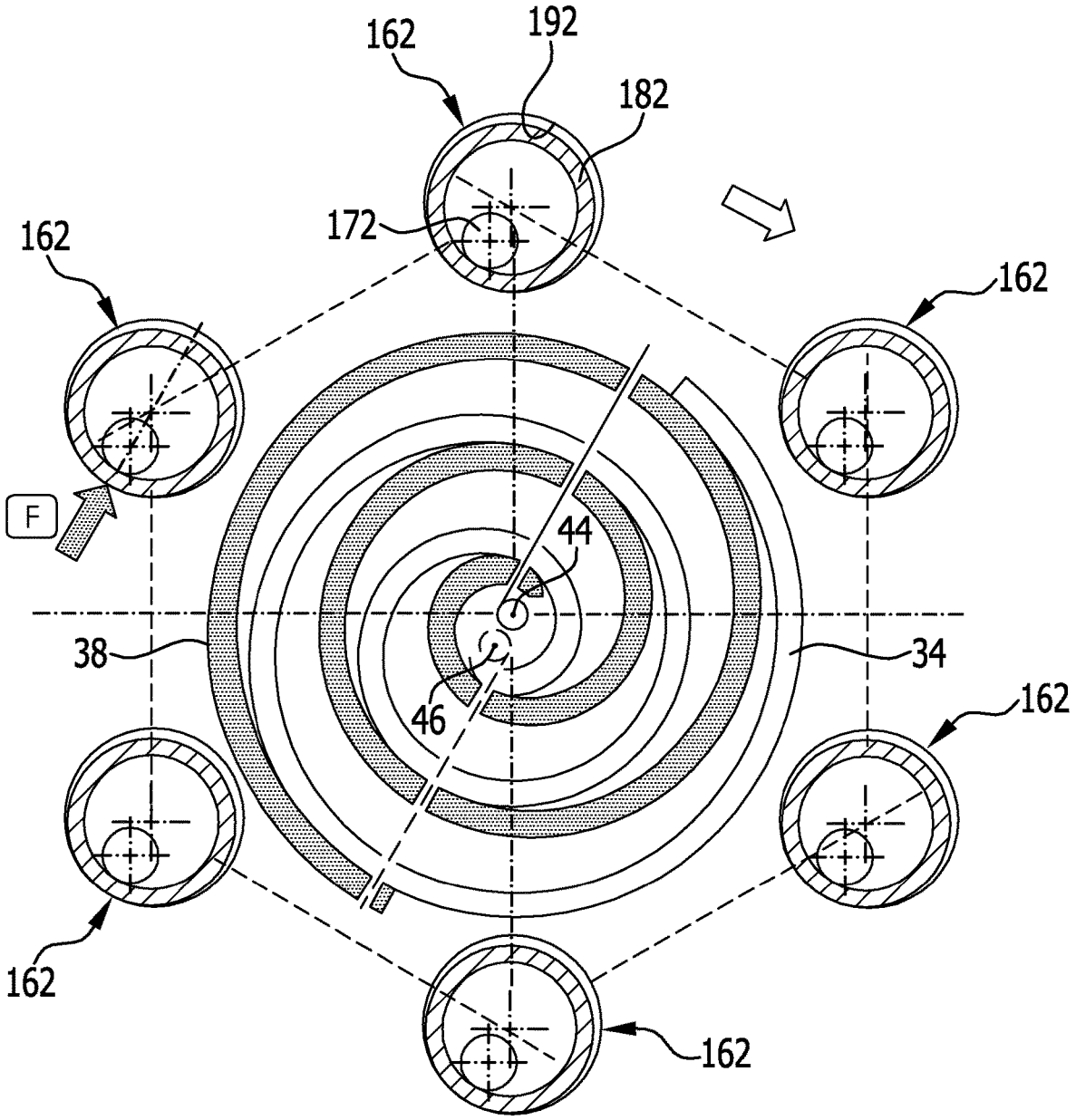
Figure 15:
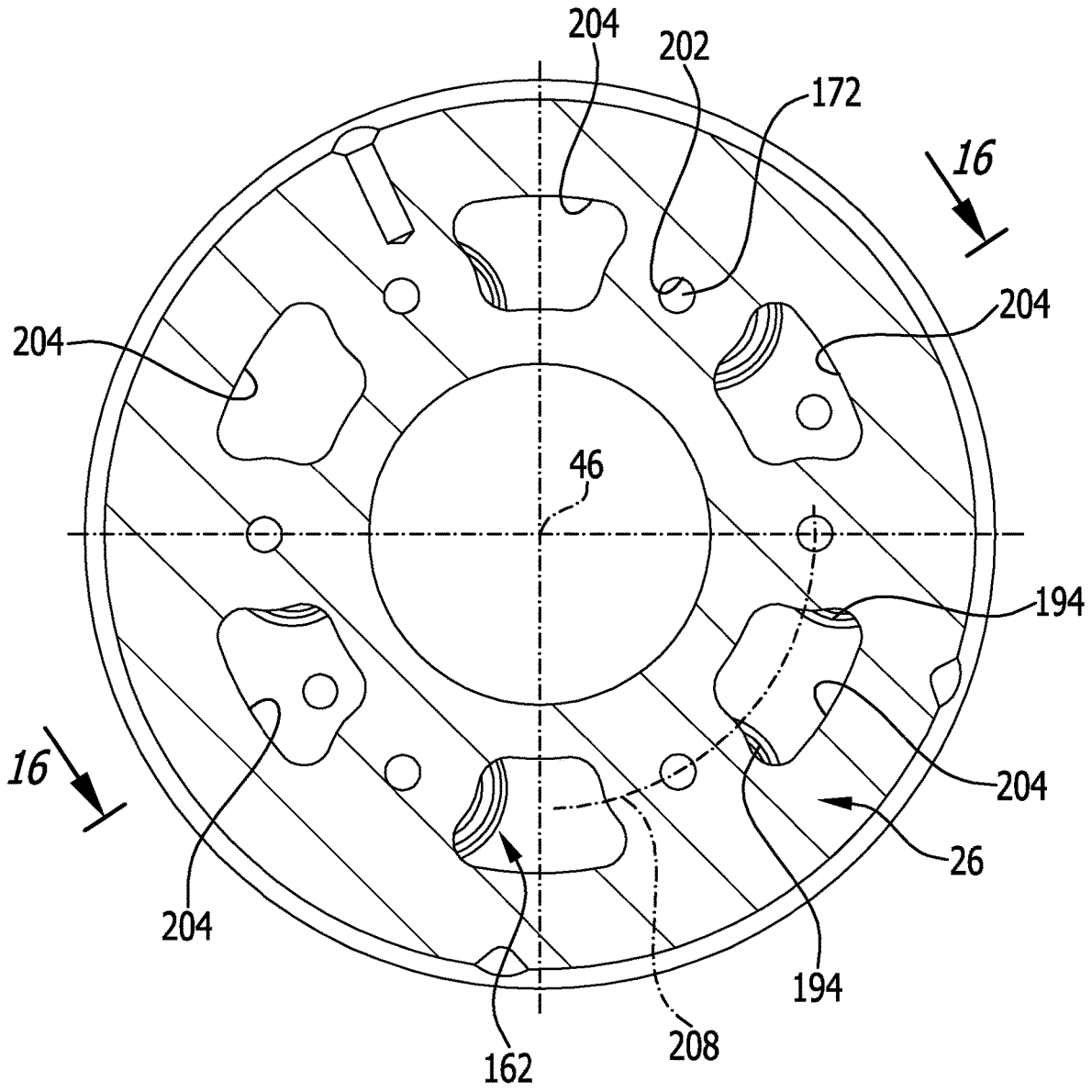
FIG. 15 shows a section along the line 15-15 in FIG. 4.

In order to assist lubrication, as illustrated in FIGS. 8 and 15, there are provided in the compressor body base 36, between the bores 202 receiving the first coupling elements 172, pockets 204 which have, in the flat side 98 that delimits the compressor body base 36, an opening 206 which has an angular extent in relation to the centre axis 46 of the compressor body base 36 such that, as illustrated in FIG. 15, they can overlap in individual rotational positions with two receptacles 194 of the coupling element sets 162 that succeed one another in the direction of rotation, with the result that the pockets 204 are in a position to perform an exchange of lubricant between successive coupling element sets 162 and thus to enable a uniform supply of lubricant to all the coupling element sets 162.

Preferably, the pockets 204 are arranged such that they extend on either side of a geometric arc 208 about the centre axis 46 which bisects the bores 202 in order always to achieve optimum overlap with the receptacles 194.

The concept according to the invention, of lubrication of the axial guide 96 and the coupling element sets 162, is particularly advantageous if in the normal case the centre axes 44 and 46 of the compressor bodies 24 and 26 extend in a level position, that is to say at an angle of at most 30° to the horizontal, in which case there is formed in the compressor housing 12, in particular in the region of the first housing body 72, at the lowest point with respect to the direction of gravity, a bath 210 of lubricant out of which lubricant swirls up during operation and in so doing is received and distributed in the manner described.

The movable compressor body 24 is driven by a drive motor which is designated 212 as a whole and which has in particular a stator 214 that is held in the central housing body 84 and a rotor 216 that is arranged within the stator 214 and is arranged on a drive shaft 218 that extends coaxially in relation to the centre axis 44 of the stationary compressor body 24.

The drive shaft 218 is mounted on the one hand in a bearing unit 222 that is arranged between the drive motor 212 and the scroll compressor unit 22 and in the central housing body 84, and on the other in a bearing unit 224 that is arranged on an opposite side of the drive motor 212 to the bearing unit 222.

Here, the bearing unit 224 is mounted for example in the second housing body 86, which closes off the central housing body 84 on an opposite side to the first housing body 72.

Medium that is drawn in here, in particular the refrigerant, flows from the inlet chamber 88 formed by the second housing body 86 and through the electric motor 212 in the direction of the bearing unit 222, flows around the latter and then flows in the direction of the scroll compressor unit 22.

By way of an eccentric drive which is designated 232 as a whole, the drive shaft 218 drives the movable compressor body 26, which moves in an orbit around the centre axis 44 of the stationary compressor body 24.

The eccentric drive 232 in particular includes an eccentric pin 234 that is held in the drive shaft 218 and moves an entrainer 236 on an orbital path around the centre axis 44, the entrainer 236 being mounted rotatably on the eccentric pin 234 and itself being mounted rotatably in a pivot bearing 238, wherein the pivot bearing 238 allows the entrainer 236 to rotate in relation to the movable compressor body 26.

The entrainer 236 is rotatable to a limited extent in relation to the eccentric pin 234 and in relation to the entrainer receptacle 242, and enables the radius of the orbital movement of the movable compressor body 26 to be adapted so that the scroll vanes 34 and 38 are kept bearing against one another.

Figure 16:
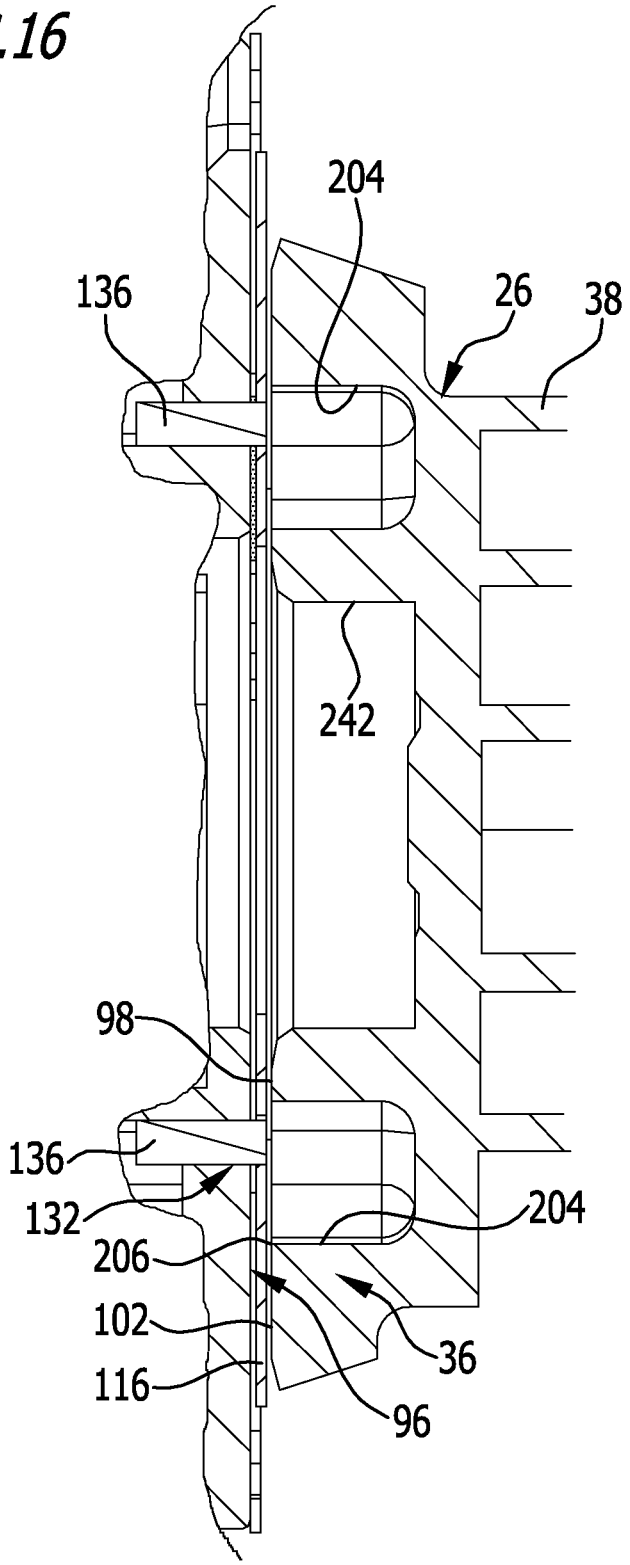
FIG. 16 shows a section along the line 16-16 in FIG. 15.

For receiving the pivot bearing 238, as illustrated in FIGS. 2, 4 and 16, the second compressor body 26 is provided with an entrainer receptacle 242 that receives the pivot bearing 238.

The entrainer receptacle 242 is in this case set back in relation to the flat side 98 of the compressor body base 36 and is thus arranged in a manner integrated within the compressor body base 36, with the result that the drive forces acting on the movable compressor body 26 act on a side of the flat side 98 of the compressor body base 36 facing the scroll vane 38 and thus drive the movable compressor body 26 with a small moment of tilt, the movable compressor body 26 being supported axially against the axial support face 102 by the axial guide 96, between the entrainer receptacle 242 and the electric motor 212 as seen in the direction of the centre axis 44, and guided movably in a direction transverse to the centre axis 44.

The invention claimed is:

1. A compressor, including a compressor housing, a scroll compressor unit that is arranged in the compressor housing and has a first, stationary compressor body and a second compressor body that is movable in relation to the stationary compressor body, whereof first and second scroll vanes, in the shape of a circle involute, engage in one another to form compressor chambers when the second compressor body is moved in relation to the first compressor body on an orbital path, an axial guide that supports the second compressor body to prevent movements in a direction parallel to a centre axis of the stationary compressor body and, in an event of movements, guides the second compressor body in a direction transverse to the centre axis, a drive motor that drives an eccentric drive for the scroll compressor unit, wherein the eccentric drive has an entrainer that is driven by the drive motor, that revolves on a path about a central axis of a drive shaft and that cooperates with an entrainer receptacle in the second compressor body, and a coupling that prevents the second compressor body from rotating freely, the axial guide supports a compressor body base, which carries the scroll vane, of the second compressor body against an axial support face, in that the axial support face abuts a sliding body such that the axial support face is slidable transversely to the centre axis, the sliding body for its part being supported, such that the sliding body is slidable transversely to the centre axis, on a carrier element that is arranged in the compressor housing; and wherein the axial support face is supported on an annular face of the sliding body that surrounds the centre axis.

2. The compressor according to claim 1, wherein the sliding body is movable in two dimensions, in relation to the compressor body base and in relation to the carrier element.

3. The compressor according to claim 1, wherein the sliding body is movably guided in a two-dimensional guidance with play in relation to at least one of the compressor body base and the carrier element.

4. The compressor according to claim 3, wherein the axial guide has a first guiding element that is arranged on the sliding body and a second guiding element that is either connected to the compressor body base or to the carrier element.

5. The compressor according to claim 3, wherein the guidance with play has, as the guiding elements, a guide pin and a guide recess that cooperates with the guide pin, and these are movable in two dimensions in relation to one another.

6. The compressor according to claim 1, wherein the axial support face takes the form of an annular face surrounding a centre axis of the second compressor body.

7. The compressor according to claim 1, wherein the axial support face is adjoined, at least one of radially outwardly and radially inwardly, by an edge face of the second compressor body base that is set back in relation to a plane in which the axial support face extends.

8. The compressor according to claim 1, wherein the sliding body is supported against the carrier element by means of a sliding bearing face.

9. The compressor according to claim 1, wherein the carrier element has a carrier face against which the sliding body is supported by means of the sliding bearing face.

10. The compressor according to claim 1, wherein the sliding body takes a plate-like form, as an annular disc.

11. The compressor according to claim 1, wherein the first, stationary compressor body is made from cast steel.

12. The compressor according to claim 1, wherein the second compressor body is made from aluminium alloy.

13. The compressor according to claim 1, wherein the sliding body is made from spring steel.

14. The compressor according to claim 1, wherein the carrier element is made from sintered material.

15. The compressor according to claim 4, wherein the carrier element has a carrier face formed by an open-pored sintered material, on which the sliding body is supported by means of its sliding bearing face.

16. The compressor according to claim 14, wherein the entrainer receptacle is integrated in the compressor body base.

17. The compressor according to claim 16, wherein the entrainer receptacle is arranged on the compressor body base such that the entrainer receptacle does not project beyond the axial support face in the direction parallel to the centre axis.

18. The compressor according to claim 1, wherein the centre axis of the stationary compressor body extends in a level position.

19. The compressor according to claim 1, wherein a drive shaft of the drive motor extends in a level position.

20. The compressor according to claim 1, wherein the compressor housing is made from an aluminium alloy.

21. A compressor, including a compressor housing, a scroll compressor unit that is arranged in the compressor housing and has a first, stationary compressor body and a second compressor body that is movable in relation to the stationary compressor body, whereof first and second scroll vanes, in the shape of a circle involute, engage in one another to form compressor chambers when the second compressor body is moved in relation to the first compressor body on an orbital path, an axial guide that supports the second compressor body to prevent movements in a direction parallel to a centre axis of the stationary compressor body and, in an event of movements, guides the second compressor body in a direction transverse to the centre axis, a drive motor that drives an eccentric drive for the scroll compressor unit, wherein the eccentric drive has an entrainer that is driven by the drive motor, that revolves on a path about a central axis of a drive shaft and that cooperates with an entrainer receptacle in the second compressor body, and a coupling that prevents the second compressor body from rotating freely, the axial guide supports the second compressor body against an axial support face that is formed by the latter such that second compressor body is slidable transversely in relation to the centre axis, and the axial support face is formed by a compressor body base of the second compressor body that carries the scroll vane; and wherein the axial support face abuts a sliding body such that the axial support face is slidable transversely to the centre axis, and wherein the axial support face is supported on an annular face of the sliding body that surrounds the centre axis.

22. The compressor according to claim 21, wherein the centre axis of the stationary compressor body extends in a level position.

23. The compressor according to claim 21, wherein a drive shaft of the drive motor extends in a level position.

24. The compressor according to claim 21, wherein the compressor housing is made from an aluminium alloy.

* * * * *